US007154234B2

(12) United States Patent
Romano et al.

(10) Patent No.: US 7,154,234 B2
(45) Date of Patent: Dec. 26, 2006

(54) LOW VOLTAGE REGULATOR FOR IN-LINE POWERED LOW VOLTAGE POWER SUPPLY

(75) Inventors: Perry Romano, Elmhurst, IL (US); Thomas J Mayer, Wisconsin Dells, WI (US)

(73) Assignee: Varon Lighting, Inc., Elmhurst, IL (US)

( * ) Notice: Subject to any disclaimer, the term of this patent is extended or adjusted under 35 U.S.C. 154(b) by 150 days.

(21) Appl. No.: 11/044,143

(22) Filed: Jan. 27, 2005

(65) Prior Publication Data

US 2005/0162100 A1 Jul. 28, 2005

Related U.S. Application Data

(60) Provisional application No. 60/539,956, filed on Jan. 28, 2004.

(51) Int. Cl.
*G05F 1/00* (2006.01)

(52) U.S. Cl. ..... 315/291; 315/307; 363/21.12

(58) Field of Classification Search ..... 315/209 R, 315/224, 276, 291, 307; 363/21.12, 21.16; 307/66, 68; 323/268
See application file for complete search history.

(56) References Cited

U.S. PATENT DOCUMENTS 5,276,376 A * 1/1994 Puskas ..... 310/317
6,191,568 B1 * 2/2001 Poletti ..... 323/268
6,728,117 B1 * 4/2004 Schemmann et al. .... 363/21.12

* cited by examiner

*Primary Examiner*—Tuyet Vo
*Assistant Examiner*—Jimmy Vu
(74) *Attorney, Agent, or Firm*—Levenfeld Pearlstein, LLC

(57) ABSTRACT

The invented voltage regulator is a solid state low voltage regulator for in-line power lines for LED arrays and incandescent lamps, preferably low-voltage halogen lamps. The invented voltage regulator comprises, in combination, a full-wave bridge rectifier circuit, a voltage sensing circuit across the output of the full wave bridge rectifier circuit, and an AC power line voltage control circuit across the output of the voltage sensing circuit, the output of the AC power line voltage control circuit controlled by a switching power control circuit to provide a regulated 11.0 to 12.5 V AC output regardless of line voltage variations.

11 Claims, 1 Drawing Sheet

LOW VOLTAGE REGULATOR FOR IN-LINE POWERED LOW VOLTAGE POWER SUPPLY

FIELD OF THE INVENTION

This invention relates to a solid state AC low voltage regulator for an in-line powered low voltage AC power supply wherein the invented voltage regulator provides a non-linear voltage response to load changes and input AC power line variations and provides a constant voltage output. More particularly, this invention relates to an AC voltage regulator for an AC low voltage power line of 12 to 15 V AC from an existing power source to supply a regulated voltage to incandescent lamps including quartz-halogen lamps and LED arrays of 11.6 V AC wherein lamp intensity remains constant regardless of AC power line voltage variations. The invented voltage regulator provides a regulated voltage output within the range of from 11.0 to 12.5 V AC to the lamp load. The invented voltage regulator is applicable to existing low voltage AC power sources such as existing transformers, either linear or switching power supplies, to limit power supply output to a safe or useable level by regulating the power line voltage. The invented voltage regulator accordingly relates to a voltage regulator circuit for an unregulated AC voltage of a low voltage AC power supply wherein the voltage regulator circuit is designed to regulate a power line low voltage to within a narrow voltage range of from 11.0 to 12.5 V AC. The invented voltage regulator accordingly reduces power line low voltage from an existing power line source to operate incandescent lamps including low-voltage quartz-halogen lighting products safely at useable lighting levels for such installations as track lighting, task lighting, indirect and outdoor lighting.

The present invention accordingly relates to voltage regulator circuit for lamps and lamp loads wherein the invented voltage regulator provides a regulated output voltage of from 11.0 to 12.5 V AC, preferably 11.6 V AC, from an unregulated input of 12–15 V AC from an existing low voltage power supply source. In particular, this invention relates to a solid state AC voltage supply as a power supply to electrical equipment which require a specific voltage input to maximize equipment output and equipment life. Very particularly, this invention relates to a solid state AC voltage operating circuit for operation of loads comprising incandescent lamps, specifically halogen lamps, although other filament type incandescent lamps and lamp loads and LED arrays are exemplified also. In regards to halogen lamps, halogen 12-volt lamps need to operate between about 11.0 and 12.5 volts for efficient light output and lamp life. Too low a voltage can damage the filament. Too high a voltage can shorten the lamp life. A 12-volt halogen lamp at 12.0 volts provides an estimated light output and lamp life of 100% of design. A 12-volt halogen lamp operating at 11.6 volts provides an estimated 93% light output with an estimated lamp life of 200% of design. It is therefore of economic advantage to operate 12-volt halogen lamps at a lower regulated voltage.

In use, the operating circuit comprising the invented voltage regulator is designed to regulate an existing lamp power source input of 12 to 15 volts AC subject to power line power fluctuations and variations to provide a narrow voltage range of from 11.0 to 12.5 V AC, preferably 11.6 V AC, for an individual existing lamp load of a quartz-halogen lamp, and other incandescent lamps and LED arrays requiring low voltage AC power line circuits of up to 300 watts. The 300 watt limitation is per the National Electric Code (NEC) regulations governing construction and installation of electrical wiring. The existing lamp power source of 12 to 15 V AC, which can fluctuate and vary in line voltage due to power line fluctuations, is thereby stabilized to provide a constant output voltage of 11.6 V AC to an individual existing lamp wherein a single fixture existing lamp runs at a predetermined lamp intensity or brightness. Each individual lamp circuit utilizes the invented voltage regulator as a component to regulate the voltage of the low voltage power source to each lamp to limit the AC voltage applied to the lamp to within the range of from 11.0 to 12.5 V AC, preferably 11.6 V AC.

Accordingly, the solid state AC voltage regulator, being of small physical size, can be incorporated into the lamp fixture base by the manufacturer of the lamp fixture base to increase lamp life and to provide a consistent lamp intensity or brightness. The invented low voltage regulator can also be an in-line component of an adapter circuit board housed in a plastic potted molded case with two connecting leads to the lamp fixture and two leads connected to a low voltage power source.

The operating circuit comprising the invented voltage regulator provides a constant output voltage of 11.6 V AC. Circuit output current is limited to 300 watts, avoiding an overcurrent condition from current overload, improper wiring and any cause of current overload because each lamp circuit is regulated by a voltage regulator circuit intrinsic with the input power circuit.

It is an object of this invention to provide a voltage regulator for an analog power supply to provide a regulated power supply wherein the regulator acts to provide a non-linear response to input voltage power line fluctuations, keeping the input voltage power line voltage constant.

It is an object of this invention to provide a voltage regulator for an analog power supply of conventional circuitry to comprise a regulated power supply to supply a non-linear regulated voltage to an LED array and to an incandescent lamp including a halogen lamp requiring a constant operating voltage with a constant voltage within the range of from 11.0 to 12.5 volts, preferably 11.6 volts.

It is an object of this invention to provide a voltage regulator with an internal voltage sensing circuit for the voltage output of a conventional analog low voltage supply, typically the voltage output of a step-down transformer of an analog power supply circuit, to initiate voltage regulation of the conventional analog low voltage supply.

It is an object of this invention to provide an analog regulated voltage power supply whose voltage regulator circuit provides a non-linear response to power line voltage variations, keeping the power supply output voltage constant.

It is an object of this invention to provide a power line voltage control circuit in combination with said sensing circuit and an input power control circuit with a switching power cycle circuit to provide an on/off switching cycle to maintain an average output voltage. The switching power cycle circuit is triggered by a feedback voltage.

In view of the above objects, the present invention relates to a voltage regulator comprising, in combination, an input current rectifier/filter circuit, a voltage sensing circuit, and a power line control circuit for controlling the power line voltage input.

The voltage regulator accordingly comprises a low voltage AC power source of 12 to 15 volts AC input, a full wave bridge rectifier circuit in the power line control circuit to convert AC line voltage to pulsating DC voltage for the opto-coupler of the power line control circuit and the voltage sensing circuit, the optocoupler across the full wave bridge rectifier circuit consisting of an optoisolator triac driver and a triac to control energy of the 12–15 V AC input and thus the power line voltage as determined by the regulated output voltage feedback to the voltage sensing circuit.

BACKGROUND OF THE INVENTION

The output of a low voltage AC power supply circuit of conventional 120 volt AC power input using the voltage regulator of this invention is regulated or limited by the voltage controller to maintain a regulated voltage of limited voltage range to operate individual LED arrays and incandescent lamps such as halogen lamps at a constant output voltage despite AC power line variations. In the instant invention, an optocoupler is utilized to control output of the power line control circuit using an off/on switching power cycle circuit of the 120 AC cycle power to maintain an average output voltage as determined by the zener diode value of the sensing circuit and the feedback voltage from output voltage of the power line control circuit.

In the prior art, the approach to controlling the lamp intensity of low voltage LED arrays and incandescent lamps such as halogen lamps often utilizes a step-down transformer of conventional design to reduce input lamp line voltage to a lower required level. Typically, unregulated fluctuations in line voltage result in unregulated step-down transformer output and can cause unregulated light output fluctuations of LED arrays and incandescent lamps including halogen lamps that can average as much as 50%. The unregulated fluctuations in line voltage and consequent unregulated output of the step-down transformer often can cause reduced lamp life.

Typically, the step-down transformer can be either a multi-tap or single tap transformer. A single transformer for an incandescent lamp of the halogen lamp type installation for track lighting, task lighting, and indirect and outdoor lighting can supply several lamp circuits, each circuit having several lamp fixtures thereto for each circuit run, up to a maximum of 300 watts per circuit per NEC limitations. Individual power requirements of 12 volt incandescent lamps can range from 10 to 75 watts per lamp for track and task lighting to power requirements of 12 volt accent flood lights and 12 volt driveway and sign lights of the range of from 10 to 75 watts per lamp.

The number of lamps per lamp circuit accordingly can vary from a maximum of 30 lamps per circuit at 10 watts per lamp to 4 lamps per circuit at 75 watts per lamp, up to a maximum of 300 watts per circuit. Typically, unregulated fluctuations in line voltage in step-down transformers for a large installation can cause the transformer housing to become hot due to heat generated by the varying electrical field, thus requiring a large transformer housing to dissipate the generated heat. The heat generated by the transformer can result in output line voltage fluctuations and unregulated light output of the incandescent lamps especially halogen lamps on the halogen lamp circuits supplied by the transformer. Again, the potential unregulated fluctuations in line voltage of an unregulated transformer output can result in shorter lamp life of an extensive lamp installation of multiple halogen or other incandescent lamps.

Accordingly, in the prior art it is well-known to utilize a means of reducing line voltage such as use of a step-down transformer to supply line power (wattage) at a constant voltage. It is well-known that step-down transformers generate heat in operation which can affect voltage output level of the transformer. It is known to use a feedback method to control line voltage. However, the concept of each element of the instant invention, the related use of an optoisolator triac driver and a triac in conjunction with a zener diode to obtain a switching power cycle of 120 times per second to maintain an average output voltage of 11.6 V AC as determined by a zener diode of a voltage sensing circuit has not been known to the inventor. The average regulated output voltage within the range of from 11.0 to 12.5 V AC is maintained regardless of variations in input line voltage to the voltage regulator resulting from power line fluctuations and transformer heat generation affecting the transformer voltage output. The operational advantages of the invented voltage regulator as applied to individual lamp applications for regulated voltage operation comprise a longer LED array life and incandescent lamp life, a lamp operation which avoids unsteady or changing light levels, wherein the lamp displays a consistent color output and consistent light intensity, and the related economic advantages of such operation. The operational advantages of the invented voltage regulator are consistent with the operational in-line application of the voltage regulator to each individual lamp to control each lamp's operation independently.

SUMMARY OF THE INVENTION

The invention relates to a novel voltage regulator designed to be installed in-line in each lamp fixture for LED arrays and incandescent lamps including halogen lamps wherein the installed voltage regulator regulates applied lamp voltage from an existing 12–15 AC voltage source to provide a lamp voltage within the range of from 11.0 to 12.5 V AC, preferably an average of 11.6 V AC, regardless of voltage variations in the input line voltage caused by power line voltage variations, power losses caused by circuit malfunctions including transformer heat generation affecting transformer voltage output. The invented voltage regulator comprises a power line voltage control circuit in combination with a voltage level sensing circuit for tungsten filaments of halogen lamps and other lamps subject to damage from power line fluctuations. A feedback circuit effects such voltage regulation to provide constant voltage regulation, in conjunction with a circuit generated switching cycle of 120 times per second to maintain a regulated voltage output within the range of from 11.0 to 12.5 V AC with an average voltage of 11.6 V AC.

DETAILS OF THE INVENTION

In the prior art, in the application of low voltage lighting for landscape accent lighting to make an outdoor area of lawns, shrubbery and plantings safer and more attractive for use at night, it has become customary to use low voltage outdoor accent lights to highlight architectural features and landscaping. The conventional installation of such low voltage lighting applications for path and garden lighting typically comprises a low voltage kit including lights, electric cable and transformer. The transformer plugs into a standard electric power outlet and reduces the regular household current supply source comprising a 120 V AC source to a 12 volt level. The low-voltage kits are often provided as do-it-yourself projects for homeowners.

The step-down transformer secondary winding AC voltage is lower than the primary winding AC voltage to obtain the voltage step-down. The lowered voltage output of a step-down transformer typically varies in direct proportion to its voltage input, thus functioning as a linear device. Thus a 132 V AC input may result in a 13.0 V AC output of a conventional step-down transformer. Varying linear voltage outputs of a conventional transformer or a pulse width modulator circuit applied to low voltage lamp, usually LED arrays and incandescent and more typically halogen lamps, result in inconsistent light output of the halogen lamps, inconsistent lamp color output, reduce lamp life, can cause the lamp fixtures and transformer to run hot because of the heat generated. In the instant invention, the voltage regulator is designed to operate as an in-line voltage regulator on the power input to each lamp fixture, individually regulating the input voltage to each lamp within the range of from 11.0 to 12.5 V AC, preferably 11.6 V AC. The application of the individual voltage regulator to each lamp of the line circuit load from the transformer insures that line fluctuations occurring through the step-down transformer applied to the entire line circuit load of several lamps do not affect the individual lamps of the line circuit.

The instant invention is designed specifically to be useful for applications utilizing a multi-tap or single tap transformer. The transformer can be a 12-volt transformer, a 15-volt single tap transformer, a single tap transformer of any voltage from 12 to 15 volts, or a 12, 13, 14, 15 volt multi-tap transformer. The instant invented voltage regulator is designed to be used to regulate the output of any 12 to 15 V AC single or multi-tap transformer to provide an 11.6 V AC current to the lamp load as a safe or usable level. Accordingly, the instant invention will provide an in-line uniform lamp voltage to provide uniform lighting levels, regardless of input line transformer voltage levels supplied to the instant voltage regulator.

Figure 1:
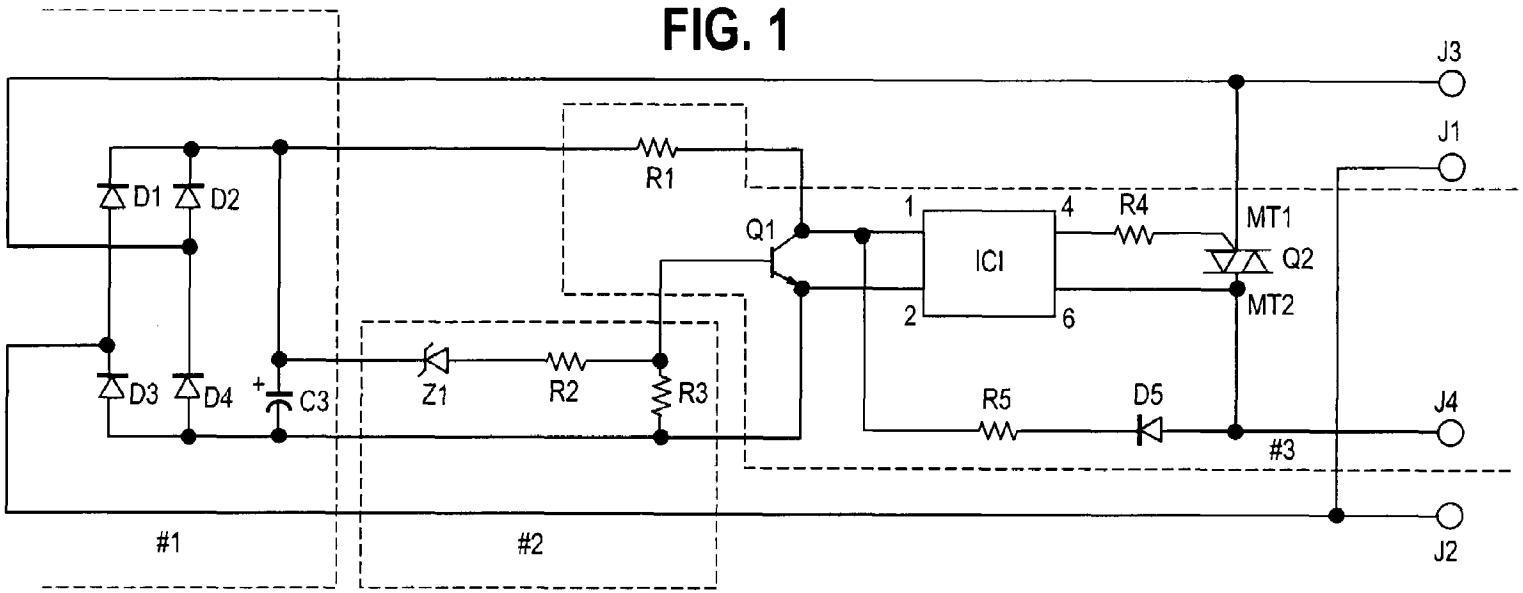
FIG. 1 is a schematic diagram of the voltage regulator of the invention showing within dashed lines the three internal circuits of the voltage regulator.
Figure 2:
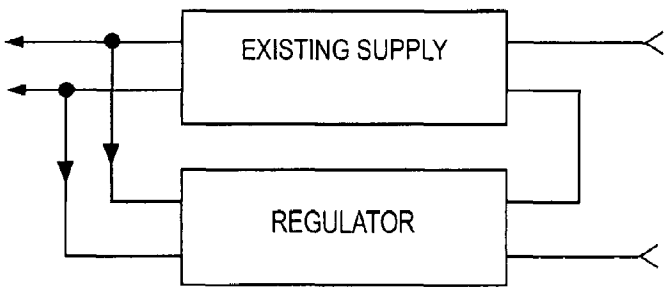
FIG. 2 is a block diagram of the application of the invented voltage regulator to an existing power supply source of 12 to 15 volts of a step-down transformer.
Figure 3:
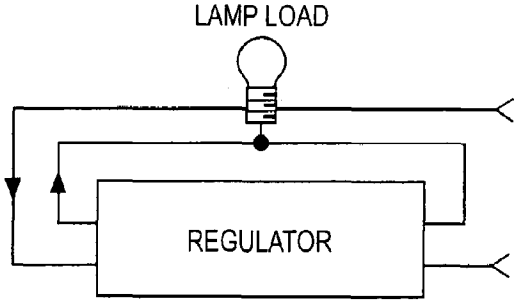
FIG. 3 is a block diagram of the application of the invented voltage regulator with a lamp load.

FIG. 1 is a detailed circuit diagram of the voltage regulator illustrative of the instant invention. Table 1 is a component listing for this circuit and provides an example of nominal values for the resistors, capacitors, transistors, integrated circuit, and voltages in the embodiment of FIG. 1.

TABLE 1

| Quantity | Component # | Component Value |
|---|---|---|
| 5 pc | D1–D5 | 1N4002 Diode |
| 1 pc | C3 | 33 mfd/35 Vdc lytic cap. |
| 1 pc | R1 | 470 ohm ¼ w 5% resistor |
| 1 pc | R2 | 4.7 K ohm ¼ w 5% resistor |
| 1 pc | R3 | 3.0 K ohm ¼ w 5% resistor |
| 1 pc | R4 | 150 ohm ¼ w 5% resistor |
| 1 pc | R5 | 560 ohm ¼ w 5% resistor |
| 1 pc | Q2 | 10 amp 200 v Triac (Teccor) |
| 1 pc | Q1 | 1.2 a 50 Vdc transistor |
| 1 pc | ICI | Optoisolator Triac Driver 400 v peak |
| 1 pc | Z1 | 9.1 v/500 mw Zener |
| 1 pc | N.A. | Heatsink Assy w/hardware |

Referring to FIG. 1, the voltage regulator is comprised of three basic circuits which are designated by three circuits within dashed lines as No. 1, No. 2, and No. 3. Circuit No. 1 is the input rectifier/filter circuit. Circuit No. 2 is the voltage sensing circuit. Circuit No. 3 is the mains power line control circuit. The input rectifier/filter circuit No. 1 is comprised of the full wave rectifier bridge circuit D1, D2, D3, D4 (BRI) and filter capacitor C3. The voltage sensing circuit No. 2 is comprised of zener diode Z1 and voltage divider resistors R2 and R3. The power line control circuit No. 3 is comprised of current limiting resistor R1, transistor Q1, optoisolator triac driver ICI, gate current limiter resistor R4, and feedback voltage diode D5 and current limiter resistor R5, and triac Q2.

Upon application of power within the range of 12 to 15 V AC from a suitable power line transformer to input power line terminals J2 and J4, input power of J4 is connected to output terminal J3 through triac Q2. Input power line terminal J4 is connected to input terminal 1 of optoisolator triac driver ICI through D5 and R5 to provide a feedback voltage for the switching power cycle circuit. Input power line terminal J2 is directly connected to output terminal J1. The output voltage made available at terminals J1 and J3 is sensed by the full wave rectifier bridge network comprised of D1–D4.

Voltage introduced across the bridge network is filtered by capacitor C3. This filtered DC voltage is imposed across the light emitting diode in the optoisolator triac driver ICI (pins 1 and 2) via current limiting resistor R1. Input AC current from terminal J4 is rectified by diode D5 and imposed as a DC voltage on the anode of the light emitting diode in the optoisolator triac driver ICI (pin 1) via current limiter resistor R5 to provide a feedback voltage.

As voltage is applied to ICI, pins 4 and 6 of ICI become conductive. In this conductive startup state, triac Q2 is turned on via the MT2/gate path. Resistor R4 serves as a gate current limiter. Triac Q2 becomes conductive, providing an output voltage at terminals J1 and J3.

The output voltage of J1 and J3 is fed back as feedback voltage to the full wave rectifier bridge circuit BRI and capacitor C3, and the diode D5 and resistor R5 as feedback voltage for the switching power cycle circuit. The same feedback voltage is sensed by zener diode Z1 in the sensing circuit. As the output voltage of J1 and J3 approaches the zener diode value of Z1, zener diode Z1 becomes conductive, biasing control transistor Q1 to turn on, in conjunction with voltage divider resistors R2 and R3. As transistor Q1 becomes conductive, voltage across pins 1 and 2 of the light emitting diode of the optoisolator triac driver ICI is reduced, turning both ICI and triac Q2 off. With triac Q2 in the off state, output voltage at J1 and J3 is reduced until zener diode Z1 and transistor Q1 are no longer conductive. Feedback voltage through diode D5 and resistor R5 to pin 1 of the ICI initiates the switching cycle again. This on/off switching cycle occurs 120 times per second, maintaining an average output voltage as determined by zener diode Z1 value.

At the initial application of power to input terminals J2 and J4, no output voltge is available at output terminal due to the non-conductive state of optoisolator triac driver ICI in conjunction with triac Q2. At application of power, AC power lines voltage from input terminal J4 to pin 1 of optoisolator triac driver applies voltages to the gate of triac Q2, forcing triac Q2 into a state of partial conduction. This low level of output voltage is fed to the full wave rectifier bridge circuit to initiate circuit function as indicated above.

In more detail, with triac Q2 in full conduction, the power line input voltage is available as the power supply input energy, resulting in voltage at output terminals J1 and J3 and forming a closed loop voltage feedback through the voltage regulator.

At the point where the voltage across the positive and negative terminals of the rectifier bridge network BRI and filter capacitor C3 exceeds the value of the value of zener diode Z1, Z1 forces a positive voltage through resistor R2 to the base of transistor Q1 of the power line control circuit. Transistor Q1 is momentarily forward biased, turning off Q2 of the power line control circuit. As the voltage drops across the rectifier bridge network BRI drops below the value of zener diode Z1, Q1 turns off, restoring full conduction to triac Q2 until voltage at BRI again reaches the value of zener diode Z1. This process is repeated by the presence of feedback voltage from diode D5 and resistor R5 applied to pin 1 of the optoisolator triac driver. This process limits the effect of power variations experienced by the power supply and extends lamp life by avoiding unsteady or changing power input.

At completion of the switching power cycle, any voltage on the input terminals from the power supply increasing beyond the limits set by zener diode Z1 produces positive voltage at Z1, as referenced by BRI minus the voltage via resistors R2/R3. Z1 again becomes conductive, again momentarily forcing the base of Q1 high, resulting in Q1 conduction. This action temporarily turns off input to ICI by shorting terminals 1 and 2, and, consequently, the conduction of Q2 ceases. Voltage across BRI and capacitor C3 and Z1 no longer controls Q1, feedback voltage returning IC1 and Q2 to full conduction. This process continues repeatedly to maintain constant voltage output of the ower supply, regardless of varying input voltages and power supply loads.

In summary, the instant invention comprises a voltage regulator circuit for in-line lamp fixtures and in-line power circuits for lamps comprising, in combination: an AC power source comprising an 12 to 15 V AC power supply of an input power circuit; an AC full wave rectifier bridge circuit and filter capacitors; a voltage sensing circuit across the output of said AC full wave rectifier bridge circuit and filter capacitors, said voltage sensing circuit comprising a zener diode and a resistor bridge network of two resistors; an AC power line voltage control switching power cycle circuit across said voltage sensing circuit and said AC full wave rectifier bridge circuit and filter capacitor, said AC power line voltage control circuit comprising a voltage-level power output control triac, an optoisolator triac driver, a transistor to control said voltage level power output control triac and the optoisolator triac driver, a resistor as a gate current limiter, a diode and current resistor to provide a feedback voltage to initiate conduction of power output control triac at application of power wherein output voltage is regulated to maintain output voltage between 11.0 volts and 12.5 volts, wherein said AC power source comprises a step-down transformer and an 120 V AC power supply thereof, wherein output voltage is regulated to maintain an average output voltage of 11.6 V AC, wherein said switching power cycle circuit maintains a switching power cycle of 120 times per second to maintain average voltage output of 11.6 V AC, wherein said regulator circuit is intrinsic with said input power circuit as an in-line component thereof, and is a solid state AC voltage operating circuit for operation of loads comprising incandescent lamps, wherein said voltage regulator circuit is incorporated into a 2 lamp fixture base to power any incandescent lamp powered thereby, wherein said voltage regulator circuit is an in-line component of an adapter circuit board housed in a potted case with connecting leads to a lamp fixture and to a low voltage power source, and wherein said voltage regulator circuit provides a non-linear voltage response to load changes and input AC power line variations. In further summary, the instant invention comprises a voltage regulator circuit for in-line lamp fixtures and in-line power circuits for lamps and LED arrays to provide a switching power cycle circuit to maintain an average output voltage of 11.6 V AC within the range of from 11.0 to 12.5 V AC, said voltage regulator circuit comprising, in combination: (a) an AC power source comprising an 12 to 15 V AC power supply of an input power circuit; (b) an AC full wave rectifier bridge circuit and filter capacitor to provide voltage feedback; (c) a voltage sensing circuit of said feedback voltage across the output of said AC full wave rectifier bridge circuit and filter capacitor, said voltage sensing circuit comprising a zener diode to bias a transistor in the AC power line control circuit and a resistor bridge network of two resistors; (d) an AC power line voltage control switching power cycle circuit across said AC full wave rectifier bridge circuit and filter capacitor and across said voltage sensing circuit to maintain a switching power cycle of 120 times per second, said AC power line voltage control switching power cycle circuit comprising a resistor as a gate control limiter, a switching cycle optoisolator triac driver, a voltage-level power output control triac, a transistor biased by said zener diode of said voltage sensing circuit to control said switching cycle optoisolator triac driver and said voltage-level power output control triac, and a diode and current limiting resistor to provide a feedback voltage from power input to initiate conduction of power output control triac at application of power and initiate said switching power cycle.

The instant invention accordingly comprises the above voltage regulator circuit wherein said AC power line voltage control switching power circuit comprises an off-on switching power cycle circuit wherein said zener diode senses feedback voltage to bias said transistor to be conductive to reduce voltage to turn off said optoisolator triac driver and power output control triac to reduce regulator output voltage to cause said zener diode and said transistor to be non-conductive wherein input AC power line voltage provides feedback voltage to said optoisolator triac driver and said triac wherein said zener diode senses feedback voltage and initiates said off-on switching power cycle; wherein output voltage is regulated to maintain output voltage between 11.0 volts and 12.5 volts AC; wherein said AC power source comprises a step-down transformer and a household current supply source comprising a 120 V AC power supply thereof; wherein said switching power cycle circuit maintains an average output voltage of 11.6 V AC; wherein said circuit maintains a switching power cycle of 120 times per second and maintains an average voltage output of 11.6 V AC; wherein said regulator circuit is intrinsic with said input power circuit as an in-line component thereof; wherein said regulator circuit is intrinsic with said input power circuit and is a solid state AC voltage operating circuit for operation of loads comprising incandescent lamps and LED arrays; wherein said voltage regulator circuit is incorporated into a lamp fixture base and into an LED array to power any incandescent lamp and LED array incorporated thereby; wherein said voltage regulator circuit is an in-line component of an adapter circuit board housed in a potted case with connecting leads to a lamp fixture and, alternatively, an LED array, and to a low voltage power source; and wherein said voltage regulator circuit provides a non-linear voltage response to load changes and input AC power line variations.

What is claimed is:

1. A voltage regulator circuit for in-line lamp fixtures and in-line power circuits for lamps and LED arrays to provide a switching power cycle circuit to maintain an average output voltage of 11.6 V AC within the range of from 11.0 to 12.5 V AC, said voltage regulator circuit comprising, in combination:

(a.) an AC power source comprising an 12 to 15 V AC power supply of an input power circuit;

(b.) an AC full wave rectifier bridge circuit and filter capacitor to provide voltage feedback;

(c.) a voltage sensing circuit of said feedback voltage across the output of said AC full wave rectifier bridge circuit and filter capacitor, said voltage sensing circuit comprising a zener diode to bias a transistor in the AC power line control circuit and a resistor bridge network of two resistors;

(d.) an AC power line voltage control switching power cycle circuit acrosss said AC full wave rectifier bridge circuit and filter capacitor and across said voltage sensing circuit to maintain a switching power cycle of 120 times per second, said AC power line voltage control switching power cycle circuit comprising a resistor as a gate control limiter, a switching cycle optoisolator triac driver, a voltage-level power output control triac, a transistor biased by said zener diode of said voltage sensing circuit to control said switching cycle optoisolator triac driver and said voltage-level power output control triac, and a diode and current limiting resistor to provide a feedback voltage from power input to initiate conduction of power output control triac at application of power and initiate said switching power cycle.

2. The voltage regulator circuit of claim 1 wherein said AC power line voltage control switchng power circuit comprises an off-on switching power cycle circuit wherein said zener diode senses feedback voltage to bias said transistor to be conductive to reduce voltage to turn off said optoisolator triac driver and power output control triac to reduce regulator output voltage to cause said zener diode and said transistor to be non-conductive wherein input AC power line voltage provides feedback voltage to said optoisolator triac driver, and said triac wherein said zener diode senses feedback voltage and initiates said off-on switching power cycle.

3. The voltage regulator circuit of claim 1 wherein output voltage is regulated to maintain output voltage between 11.0 volts and 12.5 volts AC.

4. The voltage regulator circuit of claim 1 wherein said AC power source comprises a step-down transformer and a household current supply source comprising a 120 V AC power supply thereof.

5. The voltage regulator circuit of claim 1 wherein said switching power cycle circuit maintains an average output voltage of 11.6 V AC.

6. The voltage regulator circuit of claim 1 wherein said circuit maintains a switching power cycle of 120 times per second to maintain an average voltage output of 11.6 V AC.

7. The voltage regulator circuit of claim 1 wherein said regulator circuit is intrinsic with said input power circuit as an in-line component thereof.

8. The voltage regulator circuit of claim 1 wherein said regulator circuit is intrinsic with said input power circuit and is a solid state AC voltage operating circuit for operation of loads comprising incandescent lamps and LED arrays.

9. The voltage regulator circuit of claim 1 wherein said voltage regulator circuit is incorporated into lamp fixture base and into an LED array to power any incandescent lamp and LED array incorporated thereby.

10. The voltage regulator circuit of claim 1 wherein said voltage regulator circuit is an in-line component of an adapter circuit board housed in a potted case with connecting leads to a lamp fixture and, alternatively, an LED array, and to a low voltage power source.

11. The voltage regulator circuit of claim 1 wherein said voltage regulator circuit provides a non-linear voltage response to load changes and input AC power line variations.

* * * * *